United States Patent [19]

Wright

[11] 4,212,907

[45] Jul. 15, 1980

[54] PRE-TREATMENT FOR MOLYBDENUM OR MOLYBDENUM-RICH ALLOY ARTICLES TO BE PLATED

[75] Inventor: Ralph R. Wright, Oak Ridge, Tenn.

[73] Assignee: The United States of America as represented by the United States Department of Energy, Washington, D.C.

[21] Appl. No.: 22,897

[22] Filed: Mar. 22, 1979

[51] Int. Cl.[2] ..... C25D 5/34

[52] U.S. Cl. ..... 427/309; 204/32 R; 204/38 A; 204/57

[58] Field of Search ..... 204/29, 32 R, 38 A, 204/57; 427/438, 309

[56] References Cited

U.S. PATENT DOCUMENTS

| | | | |
|---|---|---|---|
| 2,313,756 | 3/1943 | Loose | 204/32 |
| 3,290,174 | 12/1966 | Kendall | 134/3 |
| 3,446,715 | 5/1969 | Frey | 204/32 R |
| 3,935,345 | 1/1976 | Lema | 427/438 |
| 4,055,472 | 10/1977 | Freshcorn | 204/32 R |
| 4,069,110 | 1/1978 | Babuian et al. | 204/29 |
| 4,101,386 | 7/1978 | Dötzer | 204/32 R |

*Primary Examiner*—John H. Mack
*Assistant Examiner*—William Leader
*Attorney, Agent, or Firm*—R. V. Lupo; Stephen D. Hamel

[57] ABSTRACT

This invention is a method for etching a molybdenum or molybdenum-rich alloy surface to promote the formation of an adherent bond with a subsequently deposited metallic plating. In a typical application, the method is used as a pre-treatment for surfaces to be electrolessly plated with nickel. The pre-treatment comprises exposing the crystal boundaries of the surface by (a) anodizing the surface in acidic solution to form a continuous film of gray molybdenum oxide thereon and (b) removing the film.

8 Claims, No Drawings

PRE-TREATMENT FOR MOLYBDENUM OR MOLYBDENUM-RICH ALLOY ARTICLES TO BE PLATED

BACKGROUND OF THE INVENTION

This invention was made in the course of or under a contract with the U.S. Department of Energy.

The invention relates to a wet method for etching a molybdenum or molybdenum-rich alloy surface to promote the formation of a tenacious bond between the surface and a subsequently deposited metallic plating.

This invention is an outgrowth of a need for certain laser components which were to consist of highly pure molybdenum having a surface coating of nickel-phosphorus alloy. The coating was to be deposited directly on the molybdenum by means of a conventional catalytic chemical plating technique—i.e., by electroless nickel plating. Because it is well known that nickel and molybdenum bond poorly, a search was made for a conventional etching technique for promoting the formation of strong bonds therebetween. No such technique was found. For example, unacceptable bonds were obtained when molybdenum was electrolessly nickel plated after being treated with any of the following pickling solutions: nitric acid, hydrochloric acid, phosphoric acid, ammonium chloride, potassium fluoride, potassium cyanide, ammonium fluoride acid, chromic acid, chromic acid plus sulfuric acid, chromic acid plus nitric acid, potassium dichromate plus nitric acid, nitric acid plus hydrochloric acid, fluoroboric acid, fluoroboric acid plus nitric acid, hydrogen peroxide, hydrogen peroxide plus lactic acid, hydrogen peroxide plus ammonium fluoride acid, tribasic sodium phosphate, nickel nitrate, aluminum nitrate, ferric nitrate, aluminum nitrate plus nitric acid, sulfuric acid, hydrochloric acid plus sulfuric acid, hydrochloric acid plus hydrogen peroxide, copper sulfate, copper sulfate plus sulfuric acid, and nickel nitrate plus nitric acid. The tests were extended to several electro-etching techniques conducted with many of the chemicals listed above and using direct current, alternating current superimposed on direct current, and various anodic-cathodic arrangements. These also failed to produce good bonding. To summarize, the platings deposited on molybdenum treated by the foregoing techniques could be peeled from the substrate with ease.

OBJECTS OF THE INVENTION

Accordingly, it is an object of this invention to provide a novel method for etching a molybdenum or molybdenum-rich alloy surface to promote the formation of a tenacious bond between the surface and a subsequently deposited metallic plating.

It is another object to provide a novel method for preferentially etching the crystal boundaries of a molybdenum or molybdenum-rich alloy surface.

It is another object to provide an improved method for the nickel plating of molybdenum and molybdenum-rich alloys.

SUMMARY OF THE INVENTION

One form of this invention is summarized as follows: A pretreatment for a surface which is to be provided with a metallic plating deposited from solution, said surface being a material selected from the group consisting of molybdenum and molybdenum-rich alloys, comprising: anodizing said surface in an acidic medium to form thereon a continuous gray molybdenum oxide film, and removing said film.

DESCRIPTION OF THE PREFERRED EMBODIMENT

This invention is generally applicable to molybdenum and molybdenum-rich alloy articles, but for brevity it will be illustrated herein chiefly as applied to highly machined and highly pure molybdenum articles which are to be provided with a coating of electrolessly deposited nickel.

EXAMPLE

This example is directed to forming a 0.010" electrolessly deposited nickel-phosphorus plating on a 1.5"×0.019"-thick disc composed of highly pure molybdenum. The surface of the as-received disc had been machined to a smoothness of two microinches and thus was highly reflective. The disc was etched in two operations (Steps 1–2) in accordance with this invention, then rinsed to remove a surface film (Step 3), and then electrolessly plated (Steps 4–5).

1. The disc was electro-etched at 25° C. for one minute at a direct-current density of 1.0 ampere/in$^2$ in a solution comprising 10% by weight chromic acid ($CrO_3$) and 10% by volume 71% nitric acid (reagent grade) to provide the disc with a matte (non-lustrous) finish. The solution was contained in a stainless steel tank. The tank was made the cathode and the disc the anode.

2. After the electro-etched disc was rinsed with water, it was anodized at 25° C. and a direct-current density of 1.0 ampere/in$^2$ for 4 minutes in about 25% by volume aqueous solution of aminotrimethylene-phosphonic acid (such as Dequest-2000, manufactured by Monsanto Chemical Company) to preferentially etch the crystal boundaries. Anodization was conducted until a continuous opaque gray film of molybdenum oxide was formed over the entire surface of the disc.

3. After rinsing in water, the disc was agitated in a fresh solution of the kind employed in Step 1, until the gray film was removed.

4. After again rinsing in water, the disc was immersed in a conventional acid electroless nickel-plating solution, where it was made catalytic with respect to the solution by electrodepositing a minute amount of nickel thereon. This was accomplished by connecting a 5-volt d.c. power supply between the stainless steel tank and the disc for ten seconds, the disc being connected to the negative terminal. The composition of the plating solution was as follows: 0.085 mole/liter nickel sulfate; 0.25 mole/liter sodium hypophosphite; 45 milliliters/liter lactic acid converted to the sodium salt with sodium hydroxide (approximately 20 grams/liter sodium hydroxide); 0.35 ppm lead cations; and 1.5 milliliters/liter Antipit No. 7 (M and T Company). The solution pH was 4.5 and its temperature was 95° C.±2°.

5. After removal of the electrostriking voltage, the disc was left in the plating solution until the desired 10-mil-thick plating was formed; at intervals, the pH of the solution was adjusted to 4.5 by the addition of sodium hydroxide. The solution was agitated continuously and its temperature was regulated to 95° C.±2°. Following the plating operation, the disc was rinsed in water and then inspected visually. The plating was uniform and adherent, even when subjected to 65° bend tests with a one-inch radius. The electroless-nickel band to the molybdenum withstood diamond-machining to remove 5 mils from the surface in order to meet dimensional requirements.

In the foregoing Example, the conditions for pretreating the plating (e.g., the temperature, concentrations, time of treatment) had been optimized experimentally for the particular disc being processed. Other runs were conducted with molybdenum of other shapes and sizes. Each of these outer runs consisted of steps corresponding to foregoing Steps 1–5, but in each case the pre-treatment and plating variables were adjusted to near-optimum values for the particular article being processed. Thus, the operating conditions varied from those cited in the Example. These additional runs confirmed that good bonding and high-quality platings could be obtained consistently. Some of the bonds were subjected to the bend test described above. In some instances, breakage of the molybdenum substrate occurred during bending, but the plating could not be peeled from the resulting pieces. Additional experiments showed that a suitable bond was not obtained if the molybdenum article was treated as in Steps 1, 4, and 5 but not anodized and rinsed as in Steps 2 and 3.

Referring to Step 1, the electro-etching is conducted to remove the usual surface films from the molybdenum, break the surface finish, and/or remove foreign materials such as mill slag. The resulting clean surface promotes subsequent anodization of the entire surface (Step 2, above). The formation of a matte finish is indicative that the desired degree of etch has been achieved. One versed in the art can determine by merely routine experimentation whether a particular solution and a particular current density meet these criteria for a specific article. With chromic acid-nitric acid solutions, good results have been achieved with chromic acid concentrations of from about 5 to 15 weight percent and nitric acid concentrations of from about 5 to 20 volume percent, at current densities in the range of from about 0.5 to 1.5 amperes/in$^2$.

Referring to Step 2, the purpose of the anodization step is to effect preferential etching of the crystal boundaries while avoiding electropolishing. As indicated above, the formation of a gray film on the molybdenum article indicates that suitable etching of the crystal boundaries has been achieved. Anodizing is terminated when a continuous gray film is formed over the entire surface to be plated. Undesirably high current densities result in electropolishing, which is indicated by the formation of a black film. (Molybdenum articles were examined microscopically after electro-etching as in Step 1 and again after anodizing as in Step 2; the examinations confirmed that whereas Step 1 etched all of the surface except the crystal boundaries, Step 2 preferentially etched the boundaries.) As indicated above, amino-trimethylene-phosphonic acid solutions are suitable for use as the anodizing medium. Preferably, the acid concentrations are in the range of from about 15 to 35% by volume, and the current density is in the range of from about 0.5 to 1.5 amperes/in$^2$. Other acidic solutions may be capable of converting the electro-etched surface to the above-mentioned gray molybdenum oxide film. One versed in the art can determine by merely routine experimentation whether anodizing in a given acidic solution meets this requirement.

Referring to Step 3, vigorous agitation may be required to remove the film. The film should be essentially completely removed.

Referring to Step 4, any suitable technique may be used to make the molybdenum article catalytic with respect to the plating solution. For instance, the article may be made catalytic by electrostriking in a suitable nickel electroplating bath and then may be plated electrolessly. A suitable electroplating bath for such electrostriking is a so-called Gardan solution comprising 200-300 gram/liter $NiSO_4 \cdot 6H_2O$, 68–103 milliliters of 98% sulfuric acid, and 1–10 ml/liter of the aforementioned Antipit agent.

Still referring to Step 4, various conventional electroless nickel solutions (e.g., aqueous baths of the well-known nickel cation—hypophosphite anion type) may be used to deposit the plating. The baths may be of the acid or alkaline types [see ASTM Special Bulletin No. 265, "Symposium on Electroless Nickel Plating"(1965)].

Etching a molybdenum surface in accordance with Steps 1 and 2 may also promote bonding between the article and a nickel plating deposited from conventional electroplating baths. In that event, of course, the molybdenum surface need not be made catalytic before the plating operation.

The above-described electro-etching operation (Step 1) and the anodizing operation (Step 2) are believed to be applicable to molybdenum-rich alloy articles as well as to molybdenum. Given the teaching herein, one versed in the art can determine by merely routine experimentation the most suitable concentrations and current densities for a particular article to be electro-etched and then anodized as described.

It will be understood that this method is not limited to the treatment of surfaces of any particular smoothness or configuration.

What is claimed is:

1. A pre-treatment for a surface which is to be provided with a metallic plating deposited from solution, said surface being a material selected from molybdenum and molybdenum-rich alloys, comprising:

anodizing said surface in aqueous amino-trimethylenephosphonic acid solution to form thereon a continuous gray molybdenum oxide film, and removing said film.

2. The method of claim 1 wherein said solution comprises from 15 to 35% by volume amino-trimethylenephosphonic acid.

3. The method of claim 1 wherein said anodizing is conducted at a current density in the range of from 0.5 to 1.5 amperes/in$^2$.

4. A pre-treatment for a surface which is to be provided with a metallic plating deposited from solution, said surface being a material selected from the group consisting of molybdenum and molybdenum-rich alloys, comprising:

electro-etching said surface in chromic acid-nitric acid solution to provide the same with a film-free matte finish, anodizing the electro-etched surface in an acidic medium to form thereon a continuous gray molybdenum oxide film, and removing said film.

5. A method for etching a metallic material to be provided with a metallic plating, said material being selected from the group consisting of molybdenum and molybdenum-rich alloys, said method comprising:

electro-etching said material in chromic acid--nitric acid solution at a current density in the range of from about 0.5 to 1.5 amperes/in$^2$ to provide the surface thereof with a matte finish, anodizing the resulting material to form a continuous gray molybdenum oxide film thereon, and removing said film.

6. A method for etching a metallic material to be provided with a metallic plating, said material being selected from the group consisting of molybdenum and molybdenum-rich alloys, said method comprising:

electro-etching said material to provide the surface thereof with a matte finish, anodizing the resulting material in aqueous amino-trimethylene-phosphonic acid solution to form a continous gray molybdenum oxide film thereon, and removing said film.

7. The method of claim 6 wherein said anodizing is conducted at a current density in the range of from about 0.5 to 1.5 amperes/in$^2$.

8. In the method of electrolessly nickel plating a surface of a metallic material selected from the group consisting of molybdenum and molybdenum-rich alloys, said method including the steps of rendering said surface catalytic for the aqueous-bath reduction of nickel cations to metallic nickel and the corresponding oxidation of hypophosphite anions to phosphite anions and then electrolessly plating the resulting catalytic surface with nickel from an aqueous nickel cation--hypophosphite anion bath, the improvement comprising preceding said rendering step with the following sequence of operations:

electro-etching said surface in chromic acid--nitric acid solution at a current density in the range of from about 0.5 to 1.5 amperes/in$^2$ to provide it with a film-free matte finish, anodizing the electro-etched surface to form thereon a continuous gray oxide film, and removing said film.

* * * * *